US008418646B2

(12) United States Patent
Fett et al.

(10) Patent No.: US 8,418,646 B2
(45) Date of Patent: Apr. 16, 2013

(54) APPARATUS FOR APPLYING A LIQUID TO A PASSING WEB

(75) Inventors: Thomas Fett, Wesseling (DE); Sebastian Sommer, Troisdorf (DE); Heiner Schulze-Uphoff, Bonn (DE); Walter Kuehn, Sankt Augustin (DE); Michael Nitschke, Bonn (DE)

(73) Assignee: Reifenhaeuser GmbH & Co. KG Maschinenfabrik, Troisdorf (DE)

( * ) Notice: Subject to any disclaimer, the term of this patent is extended or adjusted under 35 U.S.C. 154(b) by 816 days.

(21) Appl. No.: 12/566,714

(22) Filed: Sep. 25, 2009

(65) Prior Publication Data

US 2010/0242839 A1 Sep. 30, 2010

(30) Foreign Application Priority Data

Sep. 27, 2008 (EP) ..... 08017068

(51) Int. Cl.
*B05C 1/00* (2006.01)
*B05D 5/00* (2006.01)

(52) U.S. Cl.
USPC ..... 118/244; 427/282

(58) Field of Classification Search ..... 118/244, 118/211, 212, 213
See application file for complete search history.

(56) References Cited

U.S. PATENT DOCUMENTS

| | | | | |
|---|---|---|---|---|
| 4,469,734 | A * | 9/1984 | Minto et al. | 428/134 |
| 5,466,516 | A * | 11/1995 | Lutzow et al. | 428/198 |
| 6,183,847 | B1 | 2/2001 | Goldwasser | 428/219 |
| 8,101,532 | B1 * | 1/2012 | Yananton | 442/59 |
| 2008/0011226 | A1 | 1/2008 | Fett et al. | 118/244 |

FOREIGN PATENT DOCUMENTS

| | | |
|---|---|---|
| CH | 669915 | 4/1989 |
| WO | WO 03076720 | 9/2003 |

* cited by examiner

*Primary Examiner* — Dah-Wei Yuan
*Assistant Examiner* — Charles Capozzi
(74) *Attorney, Agent, or Firm* — Andrew Wilford

(57) ABSTRACT

An apparatus for applying a treatment liquid to a web moving in a predetermined web-travel direction has an applicator element having a surface extending transverse to the direction and positioned to contact the moving web. The liquid is applied to the surface such that the liquid is transferred to the moving web where the moving web contacts the surface. A shield directly engages a portion of the surface between the web and the surface so that where the shield extends between the moving web and the surface there is generally no transfer of the liquid from the surface to the moving web. Formations on the shield conduct the liquid away from edges of the shield.

16 Claims, 3 Drawing Sheets

Fig. 1
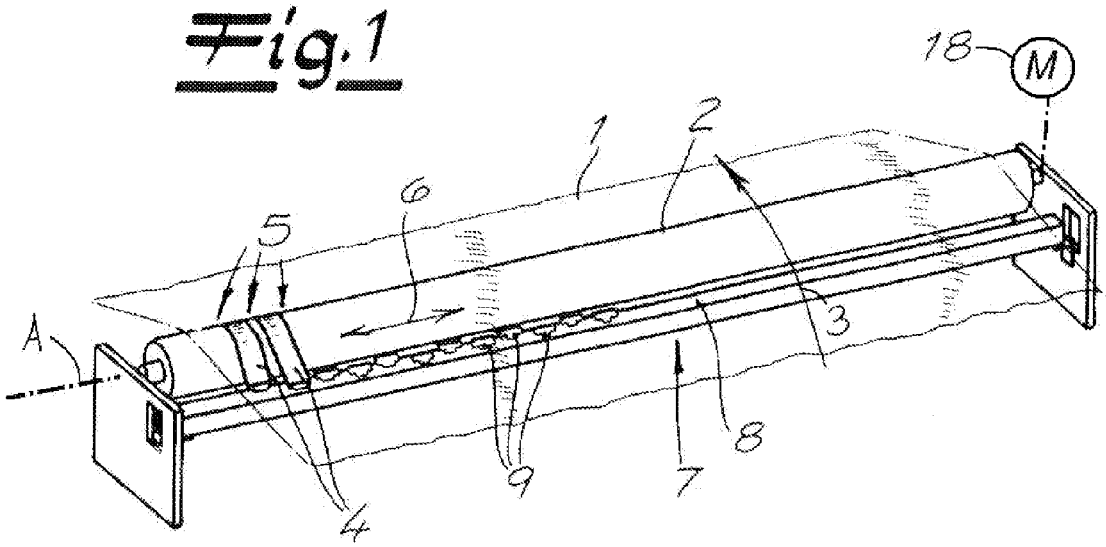
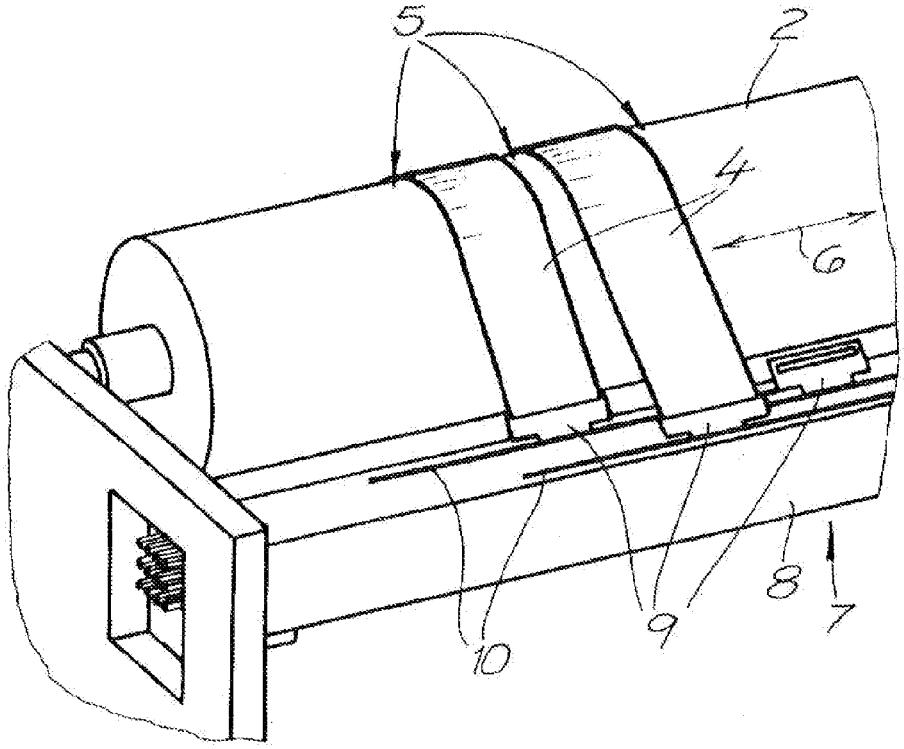
Fig. 2

APPARATUS FOR APPLYING A LIQUID TO A PASSING WEB

FIELD OF THE INVENTION

The present invention relates to an apparatus for applying a liquid to a passing web. More particularly this invention concerns an apparatus for applying a liquid to a passing web.

BACKGROUND OF THE INVENTION

In US 2008/0011226 an apparatus is described for applying a liquid to a moving web. It has an applicator element having a surface extending transverse to the web-travel direction and positioned to contact the moving web. Liquid applied to the surface is transferred to the moving web where the moving web contacts the surface. A support spaced in the web-travel direction from the applicator element has a plurality of guides extending transverse to the web-travel direction, with at least some of the guides overlapping others of the guides. Respective shields slidable in the guides transverse to the direction extend between the web and the surface so that where the shields extend between the moving web and the surface there is generally no transfer of the liquid from the surface to the moving web. Respective adjusters connected to the shields shift same in the respective guides between positions spaced from one another to positions at least partially overlapping one another.

OBJECTS OF THE INVENTION

It is therefore an object of the present invention to provide an improved apparatus for applying a liquid to a passing web.

Another object is the provision of such an improved apparatus for applying a liquid to a passing web that overcomes the above-given disadvantages, in particular that applies the fluid to the web very uniformly.

A further object is to provide such an apparatus with which a liquid can be applied onto a material web reliably, uniformly and so as to be functionally safe.

SUMMARY OF THE INVENTION

An apparatus for applying a treatment liquid to a web moving in a predetermined web-travel direction has according to the invention an applicator element having a surface extending transverse to the direction and positioned to contact the moving web. The liquid is applied to the surface such that the liquid is transferred to the moving web where the moving web contacts the surface. A shield directly engages a portion of the surface between the web and the surface so that where the shield extends between the moving web and the surface there is generally no transfer of the liquid from the surface to the moving web. Formations on the shield conduct the liquid away from edges of the shield. The treatment liquid is a finish or a softener. The characteristics and in particular the surface characteristics of the material web be changed by application of the liquid to the material web. A proven liquid is, for example, a surface-active agent, a surfactant, a mixture of surface-active agent and surfactant or a dyestuff or dyestuff solution. It is also possible to use an emulsion as a liquid.

The material web may be a nonwoven or a woven material web. Advantageously the material web is a nonwoven or spun-bonded web. According to a preferred embodiment the spun-bonded web consists of endless filaments. To produce a spun-bonded web endless filaments are preferably initially produced from at least one thermoplastic plastic by a spinneret. Advantageously the endless filaments are initially stretched after spinning and then deposited on a foraminous deposition surface to form the spun-bonded web.

The material web is guided with its lower face over the application surface and this lower face of the material web is acted upon by the liquid in the contact region of the application surface. The direction in which the material web is guided relative to the application surface at the contact region with the application surface is the feed direction.

Preferably the shield is impervious or essentially impervious to the treatment fluid and is provided between the application surface and the material web so that according to the invention there is no contact between the material web and the application surface in the shielded region. According to one embodiment of the method according to the invention a supporting portion of the shield covers the application surface such that while guiding the material web over the application surface there is no contact between the material web and the application surface. Advantageously contact takes place between the surface of the supporting portion and the lower face of the material web, and between the lower face of the supporting portion and the application surface. It lies within the scope of the invention that the supporting portion of the shield, at least in certain sections, rests on the shielded region of the application surface, and that the supporting portion, in certain areas, masks the application surface without contacting or touching it.

In a preferred embodiment the liquid-conducting formation is formed as a feed indentation in the lower face of the supporting portion so that the liquid applied to the application surface is transported away from the edge or edges of the shield, in particular due to the pressure exercised by the material web upon the shields. The supporting portion masks the application surface without contacting or touching it in the area of the feed indentation. According to one embodiment at least one liquid-conducting formation formed as a raised portion or ridge is provided on the lower face of the supporting portion, which, for example, may be shaped as a bar or a bar-shaped profile. It is recommended that the liquid applied to the application surface is transported away from the edges of the shield by the raised portion. Advantageously the shield rests against the application surface only with the raised portion, i.e. only the raised portion is in contact with the application surface. As a result an intensified or increased application of liquid onto the material web is reliably avoided, above all at the edges of the supporting portion of the shield.

A feed indentation is, for example, formed as a groove and/or is formed by a multiplicity or plurality of point-shaped indentations. In principle, the feed indentation may be configured as a random profiling, at least in the lower face of the supporting portion. A proven way of producing the feed indentation in the lower face of the supporting portion is by embossing. At least the upper face, that is the face turned radially away from the applicator roller, of the supporting portion of the shield is planar or smooth. Further it lies within the scope of the invention that more than 10%, recommendably more than 20%, advantageously more than 30%, preferably more than 50%, more preferably more than 70% of the area of the supporting portion of the shield cover the shielded region of the application surface without contacting or touching it.

According to one embodiment of the method according to the invention at least two and preferably a multiplicity or plurality of shields may be arranged on the application surface. Preferably the shields are positioned so as to be directly adjacent to each other, that is with no gap or essentially no gap formed between two adjacent shields. In this way the shielded region is enlarged. According to one variant of the embodiment a spacing is formed two adjacent shields so that preferably a strip-shaped contact region is formed between the two shields. According to one embodiment a plurality of contact regions is formed on the application surface if at least two or preferably a multiplicity or plurality of shields are arranged spaced apart next to each other on the application surface. At least two shields are positioned so as to overlap or so as to lie one above the other in certain areas so that a coherent or continuous shielded region is formed.

Advantageously the shield is formed as a rectangular or generally rectangular strip or shield strap whose the longitudinal extension extends parallel or essentially parallel to the web-travel direction and transversely to the application surface that itself normally extends perpendicular to the web-travel direction. It has been proven to produce the shield from a fiber-reinforced plastic, preferably a Teflon-coated and/or fiber-reinforced plastic. In principle it is also possible for the shield to consist, for example, of sheet metal.

Preferably the application surface is the surface of an applicator roller. Advantageously the surface of the application surface is cylindrical so that the longitudinal axis of the applicator roller extends perpendicularly or essentially transversely to the web-travel direction. The applicator roller rotates and also into a container or trough holding a bath of the treatment liquid. This coats all of the surface of the applicator roller as it rotates.

According to one embodiment at least one transport channel is formed at least in the supporting portion such that the liquid applied in the shielded region of the application surface can be discharged through the transport channel. At least sections of the transport channel extend parallel or essentially parallel to the web-travel direction in the shield. Preferably the transport channel extends completely or essentially completely parallel or essentially parallel to the web-travel direction in the shield. Advantageously the transport channel is arranged at least in the lower face of the supporting portion. The transport channel is formed as a groove and the groove extends preferably completely or essentially completely along the length of the supporting portion. The length of the supporting portion in terms of the invention means the length of the supporting portion parallel to the web-travel direction. According to one embodiment of the apparatus according to the invention the transport channel is central or essentially central on the lower face of a advantageously strip-shaped shield. It is possible that the preferably groove-shaped transport channel has interruptions. It is recommended that the liquid is discharged by the transport channel into the trough or container in which the liquid bath for application of the treatment liquid to the application surface is held.

Advantageously the liquid-conducting formation is formed as a feed indentation extending obliquely to the web-travel direction. It is recommended that the feed indentation extends obliquely to the central longitudinal axis of the shield. The central longitudinal axis is the longitudinal axis of the shield in the web-travel direction, at the center or essentially at the center of the shield.

The liquid-conducting formation is formed as a feed indentation and the feed indentation forms an orientation angle of up to 90° to the web-travel direction. Preferably the orientation angle is between 10° and 85° or more preferably between 25° and 50°. The multiplicity or plurality of feed indentations are arranged in the shield. Advantageously the liquid on the shielded region is directed away from the edges of the shield or the supporting portion to the transport channel by the feed indentation or feed indentations.

According to one embodiment at least two feed indentations and preferably a multiplicity or plurality of feed indentations are provided on the shield. According to a preferred embodiment a part, preferably a large part (more than 50%) of the feed indentations is arranged in pairs in a V-shape or herringbone array. Preferably the pairs of feed indentations arranged in a V-shape are arranged on the lower face of the supporting portion so as to be mirror-symmetric to the web-travel direction. The symmetry axis extends in the web-travel direction along the central transport channel. In a preferred embodiment the feed indentations arranged in pairs extend in a V-shape so that the V-shaped pairs of feed indentations are not connected with each other.

According to one embodiment the feed indentation is formed as a groove and/or formed of a multiplicity or plurality of punctiform indentations. The groove-shaped indentation can be formed continuously or without interruptions or essentially without interruptions. It is possible that the groove-shaped feed indentation is interrupted. Advantageously the punctiform indentations forming a feed indentation are arranged in lines or essentially linearly one behind the other. This means that the punctiform indentations of a feed indentation are arranged on an lines that preferably forms the orientation angle with the web-travel direction. In principle it would also be possible that the feed indentation is formed by punctiform indentations statistically arrayed on the lower face of the supporting portion.

According to an embodiment of the invention the liquid-conducting formation is formed as a polygonal or multi-angular feed indentation, at least one edge of the polygonal or multi-angular feed indentation and the web-travel direction enclosing the orientation angle of up to 90°. In a preferred embodiment of the apparatus according to the invention the feed indentation is parallelogrammatic and has inner and outer parallel edges extending parallel or essentially parallel to the web-travel direction and upstream and downstream edges forming the orientation angle of up to 90°, preferably between 10° and 85° and more preferably between 25 and 50° with the web-travel direction. Advantageously a multiplicity or plurality of parallelogrammatic feed indentations is arranged in the shield. It is recommended that at least a part, preferably a large part (more than 50%) of the parallelogrammatic feed indentations be arranged in pairs in a V-shape. The parallelogrammatic feed indentations arranged in pairs in a V-shape are arranged so as to be mirror-symmetrical to the web-travel direction or the central longitudinal axis of the shield on the lower face of the supporting portion.

At least the supporting portion of the shield is formed at least in two layers, the feed indentation being formed in the lower layer. The upper layer according to one embodiment of the invention is wider than the lower layer of the supporting portion. It is recommended that the edges of the upper layer of the supporting portion extending parallel or essentially parallel to the web-travel direction extend transversely beyond the edges of the lower layer of the supporting portion by preferably 0-8 mm, more preferably by 0-5 mm and especially more preferably by 0-3 mm. Advantageously the upper layer of the supporting portion is of the same exact width as the lower layer of the supporting portion. It is possible that the shield is formed completely or essentially completely at least in two or more than two layers. Advantageously the feed indentation is formed at least on the lower layer forming the lower face of the shield. The feed indentation is formed in the lower face of the supporting portion of the shield by embossing or and/or the raised portion is molded onto the lower face of the shield. Preferably the upper layer or the upper face of the shield has a smooth or plane surface at least in the supporting portion. In this way damage to the material web guided over the shield is reliably avoided. A layer on the upper face of the shield or the supporting portion of the shield is impervious or essentially impervious to fluid.

The feed indentation is formed as a recess in the lower layer. In a preferred embodiment the recess is exclusively formed on the lower face of the supporting portion of the shield.

Advantageously at least two shields are displaceable on the application surface, and an adjuster comprising a plurality of connecting elements is provided. Preferably one connecting element can be connected to each shield. The connecting elements are displaceable by the adjuster such that the shields can be positioned over the application surface so as to be directly adjacent and/or overlapping.

According to one embodiment of the apparatus according to the invention at least a part of the connecting elements in the adjuster are staggered relative to each other such that when displacing these connecting elements at least some of them elements are displaceable over at least a part of their displacement stroke so that they can be moved past each other without colliding. Advantageously the connecting elements are displaceable axially of the applicator roller or transversely to the web-travel direction. Two of these connecting elements can be moved past each other without colliding, so that shields connected to both connecting elements are moved over each other or are arranged on the application surface so as to overlap one another. In other words, when the connecting elements can be displaced without colliding, it is possible to push the shields connected to the connecting elements over one another.

Advantageously the adjusters are independently adjustable adjusting spindles or rods so that at least one connecting element is connected to each adjusting rod, and so that by operating an adjusting rod, the connected connecting element (s) is/are displaceable. It is recommended that only one connecting element with preferably only one shield is connected to each adjusting rod. The adjusting rods extend axially or essentially axially of the applicator roller.

It is recommended that shields be removable or uncouplable from the connecting elements and/or that the shields be connected to free connecting elements. This allows for a variation of the application surface or a variable design of the contact surface between applicator roller and material web in order to form different striped patterns.

The shields are each attached with only one end to the respective adjuster or to the connecting element of the respective adjuster. In other words the shields in this embodiment have one free end and rest loosely on the application surface or on the applicator roller. It is possible for the shields to be connected with both ends to the adjuster or the connecting elements of the adjuster.

The invention is based on the recognition that with the apparatus according to the invention a striped pattern may be reliably created on the material web, the application meeting the most stringent requirements. The apparatus according to the invention prevents an application of increased amounts of liquid at the edge or the edge areas of the shields in a surprisingly simple manner, so that the strips of the material web acted upon by the liquid are coated with a uniform and constant amount of the liquid both parallel and transversely to the web-travel direction. As a result the material web coated with the apparatus according to the invention has an outstanding appearance or optimal characteristics that can be set in a simple and reliable manner and are reproducible.

Furthermore the invention is based on the recognition that the striped pattern to be produced with the apparatus according to the invention is easily adjustable and variable without problems. It should be pointed out that the variability of the strips or the striped pattern, apart from the number of strips, also comprises the width of the strips. It is highly advantageous that the striped pattern can be both adjusted or altered also during operation. Furthermore it should be pointed out that existing plants can be retrofitted with the apparatus according to the invention without problems.

BRIEF DESCRIPTION OF THE DRAWING

The above and other objects, features, and advantages will become more readily apparent from the following description, reference being made to the accompanying drawing in which:

FIG. 1 is a perspective view of the apparatus according to the invention;

FIG. 2 is a larger-scale view of the adjuster of the FIG. 1 apparatus;

SPECIFIC DESCRIPTION

Figure 3C:
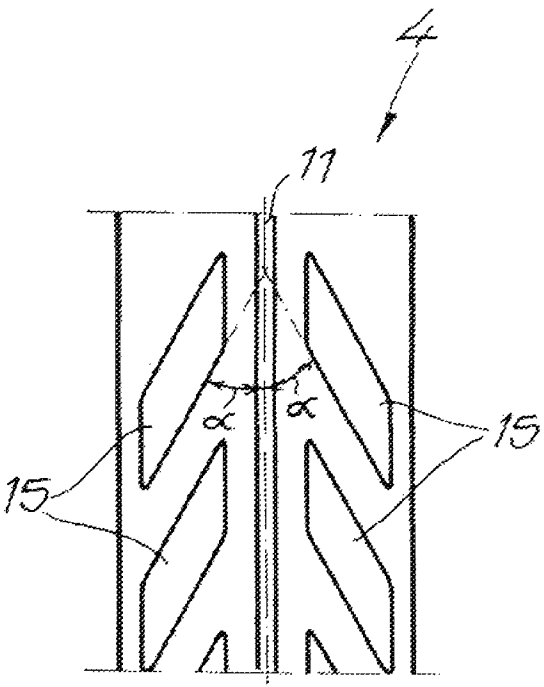
FIGS. 3*a*, 3*b*, and 3*c* are views of lower faces of different separators.

As seen in FIG. 1 an apparatus according to the invention applies fluid media or lubricants to a nonwoven web 1, guided in horizontal web-travel direction D across an application surface formed by the cylindrical outer surface of an applicator roller 2 centered on a horizontal axis A perpendicular to the direction D. The applicator roller 2 is rotated by a motor illustrated schematically at 18 so that in its upper region where it contacts the web 1 it moves codirectionally with the web 1 and preferably at the same speed. The roller 2 sits in a supply trough filled with a treatment liquid, here a finish solution, so that as it rotates it picks up the liquid and transfers it to the bottom face of the passing web 1 in regions 5 where it contacts same.

In the embodiment according to FIGS. 1 and 2 two shields are shown formed as shield straps 4 that 4 cover shielded regions on the applicator roller 2 so that in these shielded regions there is no contact between the nonwoven web 1 and the applicator roller 2. In this way no liquid is applied to strips of the nonwoven web 1. On the other hand liquid is applied to the nonwoven web 1 in the strip-shaped contact regions 5 between the shield straps 4. The finish is thus applied in strips to the nonwoven web 1.

The shield straps 4 are displaceable on the applicator roller 2 parallel to its axis A as shown by double-headed arrow 6. FIGS. 1 and 2 show an adjuster 7 with a housing 8 in which a plurality of connecting elements 9 are guided. Preferably and in the illustrated embodiment a shield strap 4 is connected to each of these connecting elements 9. The connecting elements 9 are displaceable parallel to the axis A so that the shield straps 4 connected to them are also axially displaceable. The connecting elements 9 are staggered relative to each other so that as discussed in the above-cited US patent reference adjacent connecting elements 9 can overlap and move past each other without colliding.

In the embodiment according to FIGS. 1 and 2 the connecting elements 9 are guided in slots 10 of the housing 8. These slots 10 and the displacement paths they define for adjacent connecting elements 9 are staggered to allow the connecting elements 9 to be moved past each other without colliding. If the shield straps 4 are connected to two of these adjacent connecting elements 9 whose displacement paths or guide slots 10 overlap, then these shield straps 4 also overlap on the applicator roller 2. In the embodiment the extent of overlap of these shield straps 4 can be set so as to be variable and continuous by appropriate movement of the connecting elements 9. Preferably and in the illustrated embodiment the adjuster 7 comprises independently operable respective adjustment spindles coupled to the connecting elements 9 to move them parallel to the axis A of the applicator roller 2. In this way the shield straps 4 shown in FIGS. 1 and 2 are moved parallel to the axis A of applicator roller 2.

Figure 3B:
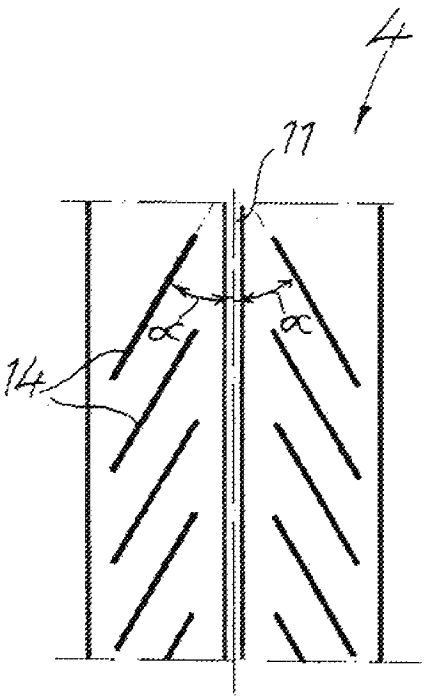
Figure 3A:
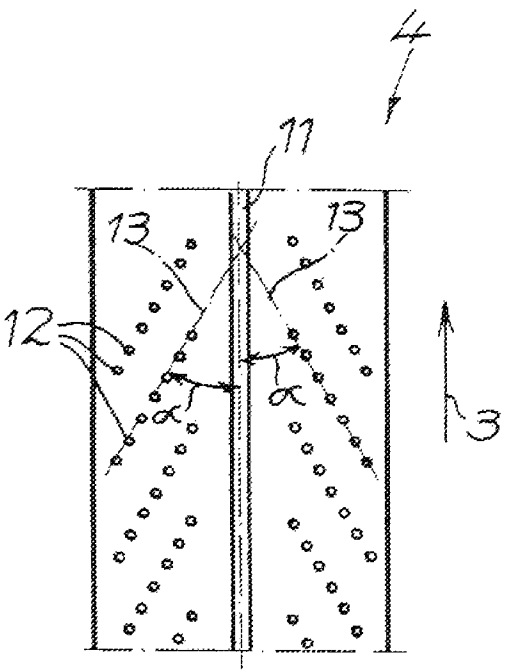

FIGS. 3*a* to 3*c* show the lower faces of the shields 4 that engage with the application surface of the applicator roller 2. FIG. 3*a* shows a shield strap 4 in which a central groove 11 is formed to serve as a transport channel. According to FIG. 3*a* punctiform feed indentations 12 are provided on the shield lower face, preferably arranged in lines 13 in a herringbone pattern. These the feed indentations are provided on both sides of the central groove 11 the lines 13 that form an angle $\alpha$ of 30° with the groove 11.

FIG. 3*b* shows a further embodiment of a shield strap 4 according to the invention, whose lower face is also formed with a central groove 11 as a liquid-transport channel. Here the lower face of the shield strap 4 also has groove-shaped feed indentations 14, again arranged in a herringbone pattern, that is symmetrically to the groove 11 and here again extending at the angle $\alpha$ of 30° to this groove 11.

FIG. 3*c* shows a further embodiment of a shield strap 4 whose lower face again has a central liquid-transport groove 11 flanked by feed indentations 15 of parallelogrammatic shape, with inner and outer edges parallel to the longitudinally extending central channel 11 and front and rear edges extending parallel to each other at 30° to the channel 11.

The web transport direction 3 in FIGS. 3*a* to 3*c* also indicates the movement direction of the application surface of the applicator roller 2 relative to the shield straps 4. The finish fed in the area of shield straps 4 to the application surface where the shield straps 4 rest or cover the application surface of the roller 2 is moved by the feed indentations 12, 14 and 15 axially inward to the respective central groove 11. In this way the finish between the application surface of the roller 2 and the shield straps 4 is prevented by pressure acting upon shield straps 4 from being pushed axially outward away from the groove 11 toward the edges of the shield straps 4, thereby creating an uneven application of finish onto the nonwoven web 1. According to FIGS. 3*a* to 3*c* the finish applied to the application surface of applicator roller 2 in the area of the shield straps 4 is directed, along the central groove 11, back to the unillustrated tough where the lower part of the roller 2 sits in a bath of the treatment liquid. The groove 11 and the feed indentations 12, 14, and 15 are embossed into the lower face of the shield straps 4.

Figure 4:
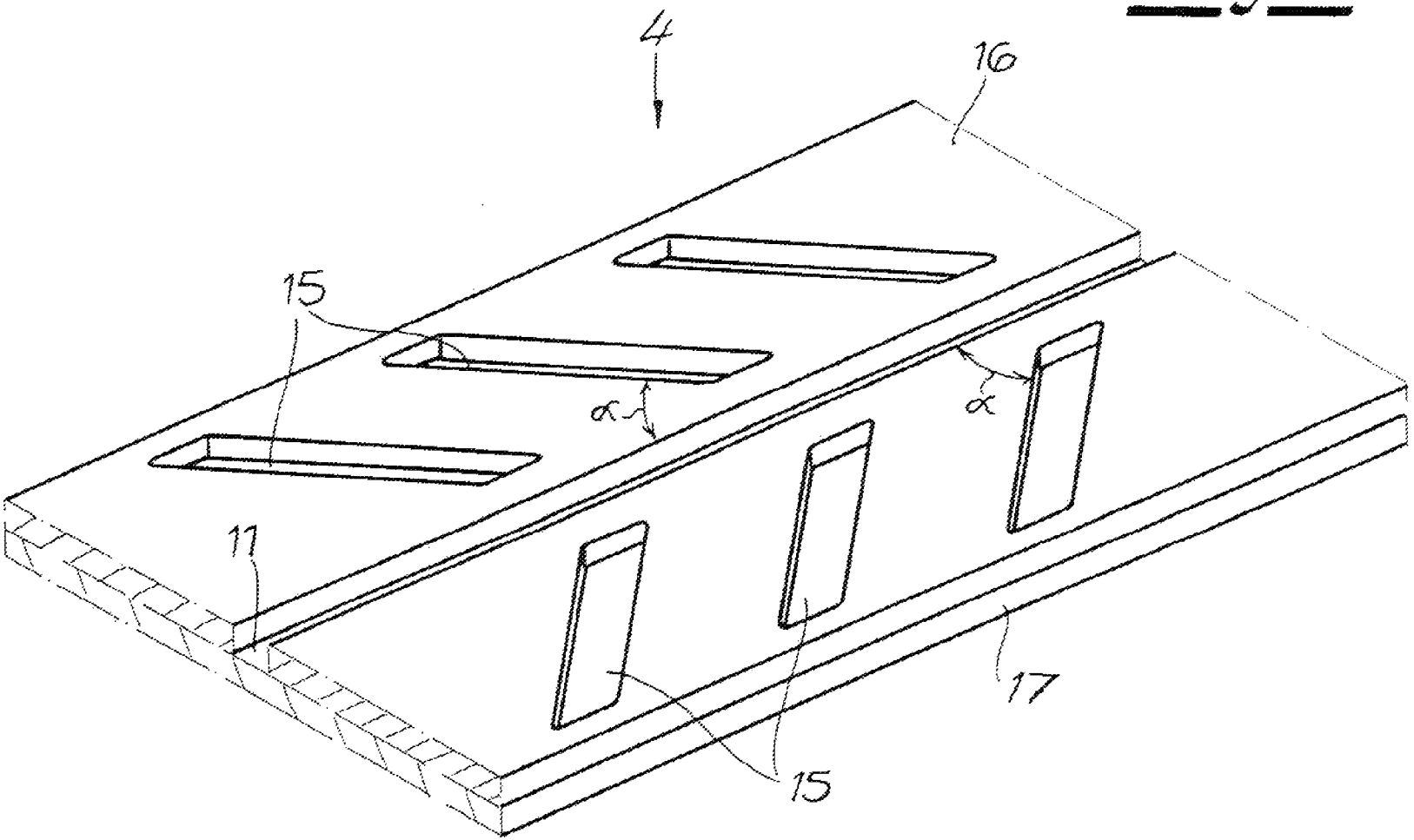
FIG. 4 is a perspective view of a detail of a two-layer separator.

FIG. 4 shows a further embodiment of a shield strap 4 has of two layers. In lower face (here turned up) intended to engage the roller 2 there is a lower layer 16 formed with the central groove 11 serving as a liquid-transport channel. This lower layer 16 is flanked as in FIG. 3*c* by rows of parallelogrammatic recesses 15. Preferably and according to the embodiment in FIG. 4 the upper face turned away from the roller 2 is formed by an upper layer 17 that is impervious to fluids and has no recesses and no indentations or through holes.

We claim:

1. An apparatus for applying a liquid to a web moving in a predetermined web-travel direction, the apparatus comprising:

an applicator element having a surface extending transverse to the direction and positioned to contact the moving web;

means for applying the liquid to the surface such that the liquid is transferred to the moving web where the moving web contacts the surface;

a shield directly engaging a portion of the surface between the web and the surface, whereby where the shield extends between the moving web and the surface there is generally no transfer of the liquid from the surface to the moving web; and formations on the shield conducting the liquid away from edges of the shield and including a groove on a face of the shield turned toward the surface and extending generally in the direction and indentations on the face of the shield to each side of the groove, the indentations being arrayed to extend or lie in lines extending at an acute angle to the groove and each having, relative to the travel direction, downstream ends closer to the groove than upstream ends.

2. The apparatus defined in claim 1, further comprising an applicator roller having an outer surface forming the application surface.

3. The apparatus defined in claim 2 wherein the roller is centered on and rotatable about an axis generally perpendicular to the direction and the web tangentially engages and passes over the roller, and the shield is stationary, the apparatus further comprising:

means for rotating the roller about the axis in a direction such that the surface moves codirectionally with the web where the surface engages the web.

4. The apparatus defined in claim 1 wherein the indentations or lines extend at about 30° to the groove.

5. The apparatus defined in claim 1 wherein the indentations are rows extending along the lines of punctiform recesses.

6. The apparatus defined in claim 1 wherein the indentations are elongated and form a herringbone array with the groove.

7. The apparatus defined in claim 6 wherein the indentations are generally parallelogrammatic.

8. The apparatus defined in claim 7 wherein the parallelogrammatic indentations each have parallel inner and outer edges parallel to the groove and outer edges of the shield and parallel leading and trailing edges bridging leading and trailing ends of the inner and outer edges and extending at a acute angle to the groove and outer edges.

9. The apparatus defined in claim 8 wherein the shield is formed of an inner layer forming the groove and indentations and of a moisture-impervious outer layer with no throughgoing holes.

10. The apparatus defined in claim 3, further comprising:

a support spaced in the web-travel direction from the applicator element;

a plurality of guides on the support extending transverse to the web-travel direction, at least some of the guides overlapping others of the guides transverse to the web-travel direction, each of the guides slidably receiving a respective one of the shields slidable for movement transverse to the direction; and respective adjuster means connected to the shields for shifting same in the respective guides between positions spaced from one another to positions at least partially overlapping one another.

11. The apparatus defined in claim 10 wherein the support is upstream in the web-travel direction from the roller and the shields are flexible elongated straps extending from the support downstream in the web-travel direction to the roller, whereby the codirectionally moving web and roller surface region exert tension on the straps and hold them taut.

12. The liquid-applying apparatus defined in claim 11 wherein the straps each have relative to the web-travel direction an upstream end secured to the respective guide and a free and unattached downstream end.

13. The liquid-applying apparatus defined in claim 11 wherein the guides are arranged in at least two different rows spaced apart in the web-travel direction such that some of the shields can move transversely of the web-travel direction past other of the shields.

14. The liquid-applying apparatus defined in claim 11 wherein the support has a plurality of groups of the guides and the guides in each group transversely overlap one another.

15. The liquid-applying apparatus defined in claim 11 wherein each strap has an upstream end provided with a clip slidable in the respective guides.

16. The liquid-applying apparatus defined in claim 5 wherein the upstream ends are releasably attached to the respective clips.

* * * * *